US005519429A

United States Patent [19]

Zwijsen et al.

[11] Patent Number: 5,519,429

[45] Date of Patent: May 21, 1996

[54] THERMAL IMAGE RECORDING APPARATUS

[75] Inventors: Jan Zwijsen, Wilrijk; Paul Leys, Kontich, both of Belgium

[73] Assignee: Agfa-Gevaert N. V., Mortsel, Belgium

[21] Appl. No.: 161,254

[22] Filed: Dec. 2, 1993

[30] Foreign Application Priority Data

Dec. 14, 1992 [EP] European Pat. Off. ..... 92203894

[51] Int. Cl.[6] ..... B41J 2/32

[52] U.S. Cl. ..... 347/223; 361/697

[58] Field of Search ..... 347/18, 223; 400/719, 400/124.13; 361/691–697, 724, 688

[56] References Cited

U.S. PATENT DOCUMENTS

| | | | |
|---|---|---|---|
| 5,053,792 | 10/1991 | Une | 347/223 |
| 5,237,338 | 8/1993 | Stephenson | 347/223 |
| 5,374,944 | 12/1994 | Janosky et al. | 347/223 |

FOREIGN PATENT DOCUMENTS

| | | | |
|---|---|---|---|
| 253300 | 10/1989 | Japan | 361/694 |

*Primary Examiner*—N. Le
*Attorney, Agent, or Firm*—William J. Daniel

[57] ABSTRACT

A thermal image recording apparatus for recording an image on a recording medium has a housing and mounted within the housing a subhousing containing a thermal print head formed of a thermal printing circuit, including an array of individual activatable heating elements, and a heat sink in conductive contact with such elements for cooling the same, a blower for creating a stream of cooling air and air guides for guiding the air stream into contact with the heat sink and thence to the outside of the housing. A platen roller is in the housing for supporting the recording medium in a recording position and the subhousing is pivotally mounted in the housing to bring the print heat into and out of an operative position with the heating elements proximate to the recording medium. The subhousing has an opening in its bottom wall through which the heating elements project in exposed relation to the recording medium while the heat sink extends into the subhousing interior. The blower is situated within the subhousing and communicates via air intake and exhaust openings in another wall of the subhousing directly with the atmosphere outside the housing without significant communication with the housing interior to thereby avoid heating of the housing interior.

8 Claims, 6 Drawing Sheets

THERMAL IMAGE RECORDING APPARATUS

BACKGROUND OF THE INVENTION

1. Field of the Invention

The present invention relates to a thermal image recording apparatus which comprises a thermal print head provided with a heat sink.

2. Description of the prior art

In the thermal printing process, a dye-bearing donor ribbon is brought into contact with a dye-receiving print sheet located at a print zone. The donor ribbon can be advanced in one direction and thermal printing is effected by contacting the donor ribbon with a multi-element print head which spans the ribbon in a direction transverse to the direction of ribbon travel. The print head typically comprises a linear array of closely spaced resistive heating elements, each being independently addressable by an applied voltage to heat that portion of the donor ribbon directly opposite and thereby cause dye to transfer from the donor ribbon to the print sheet. To maintain intimate contact between donor ribbon and print sheet during this printing operation, the donor ribbon and print sheet are partially wrapped over the surface of a rotatably driven platen roller.

The degree or density of picture element formation on the print sheet depends on the temperature of the heating elements and on the temperature of the print head itself. The electric energy applied to the heating elements is kept within a prescribed range by a control circuit. The temperature of the print head itself, on the other hand, is kept under control by dissipation of the heat accumulated during printing by means of a heat sink. To that end, a stream of cooling air produced by a blower is directed over the fins provided for that purpose on the heat sink.

The blower for cooling the print head is located within the housing of the image recording apparatus. This has the disadvantage that the air heated by the heat sink circulates within the image-recording apparatus, thereby increasing the temperature inside this apparatus and reducing the life of various components, especially electric components.

It has been proposed to overcome this problem by providing a thermal-image recording apparatus with duct means for guiding the stream of air used for cooling heat sink to the outside of the image-recording apparatus. This technique is disclosed in U.S. Pat. No. 5,053,792.

The mentioned solution does not solve, however, the problem of air circulation through the interior of the image-recording apparatus since-all the air drawn by the ventilator means passes through a substantial part of the interior of the apparatus whereby environmental dust and other particles carried by the air become deposited eventually on the surface of the print head, on rotating parts, on lubricated surfaces, etc. This deposition requires a regular maintenance of the apparatus as well as risks of causing damage to delicate components.

SUMMARY OF THE INVENTION

OBJECT OF THE INVENTION

The present invention aims to provide a thermal image recording apparatus which comprises a print head, wherein the stream of air used in the cooling of a heat sink of such head does not circulate over delicate components of the apparatus.

STATEMENT OF THE INVENTION

In accordance with the present invention, a thermal image recording apparatus which comprises a print head having a thermal print circuit and a heat sink, ventilation means for producing a stream of air for cooling said sink, and means for guiding said stream of air after having cooled said heat sink outside said image-recording apparatus, is characterised in that said print head is mounted in a subhousing which is movably mounted in the housing of the image-recording apparatus for locating the print head towards and away from a platen roller, the heat sink of the print head extending into the subhousing through an opening in the bottom wall while the print circuit remains exteriorly, the subhousing being all-sided closed except for air intake and air exhaust openings that do not communicate with the housing of the image-recording apparatus, and the ventilation means being mounted in said subhousing for drawing air through the air intake opening, directing said air over the heat sink and discharging the air thus heated through the air exhaust opening.

The term "print head" stands for the assembly of a thermal print circuit comprising a printed circuit board with a linear array of closely spaced resistive heating elements, electronic circuitry for supplying the image signals thereto and connectors for connecting the print circuit to the circuitry of the apparatus, and a heat sink. The thermal print circuit is in heat-conductive contact with the bottom surface of the heat sink. If desired, the thermal print circuit may be screw-fitted to the heat sink, but often the thermal print head is fixedly attached to the sink by means of a heat-conductive resin. As a result, the electronic and the cooling part constitute in fact one unit, called herein print head.

The expression "do not communicate" means there is no intentional or functional communication between said air intake and exhaust openings and the housing as such of the image recording apparatus. However, there may be occasional small air gaps creating some minor air communication between the intake and/or the exhaust openings and the housing so that yet there may be a small air circulation in the housing of the apparatus. For the purposes of the present invention such minor circulation is neglectible as compared with the prior art arrangements wherein all of the cooling air flows through the apparatus.

The same remark applies to the mounting of the thermal print head in the subhousing, which mounting need not be absolutely airtight since a minor leakage of air through it does not destroy the advantage of the invention. The latter situation is notably the case when the width of the heat sink of the print head is smaller than the width of an opening in the bottom wall of the subhousing as may be the case when the print head is supported only on its lateral ends. This arrangement allows a greater tolerance in the degree of finishing or of the straightness of the corresponding wall of the subhousing since now surface contact of the print head with the subhousing is limited to two laterally spaced zones. According to a suitable embodiment of the invention, any gap between the base of the heat sink of the print head and the adjacent edge of an opening is less than 0.5 mm.

According to a suitable embodiment of the invention, the print head is provided with holes co-operating with register pins mounted on the subhousing for determining the exact lateral position of the head.

BRIEF DESCRIPTION OF THE DRAWINGS

The invention will be described hereinafter by way of example with reference to the accompanying drawings wherein.

DETAILED DESCRIPTION OF THE INVENTION

Figure 1:
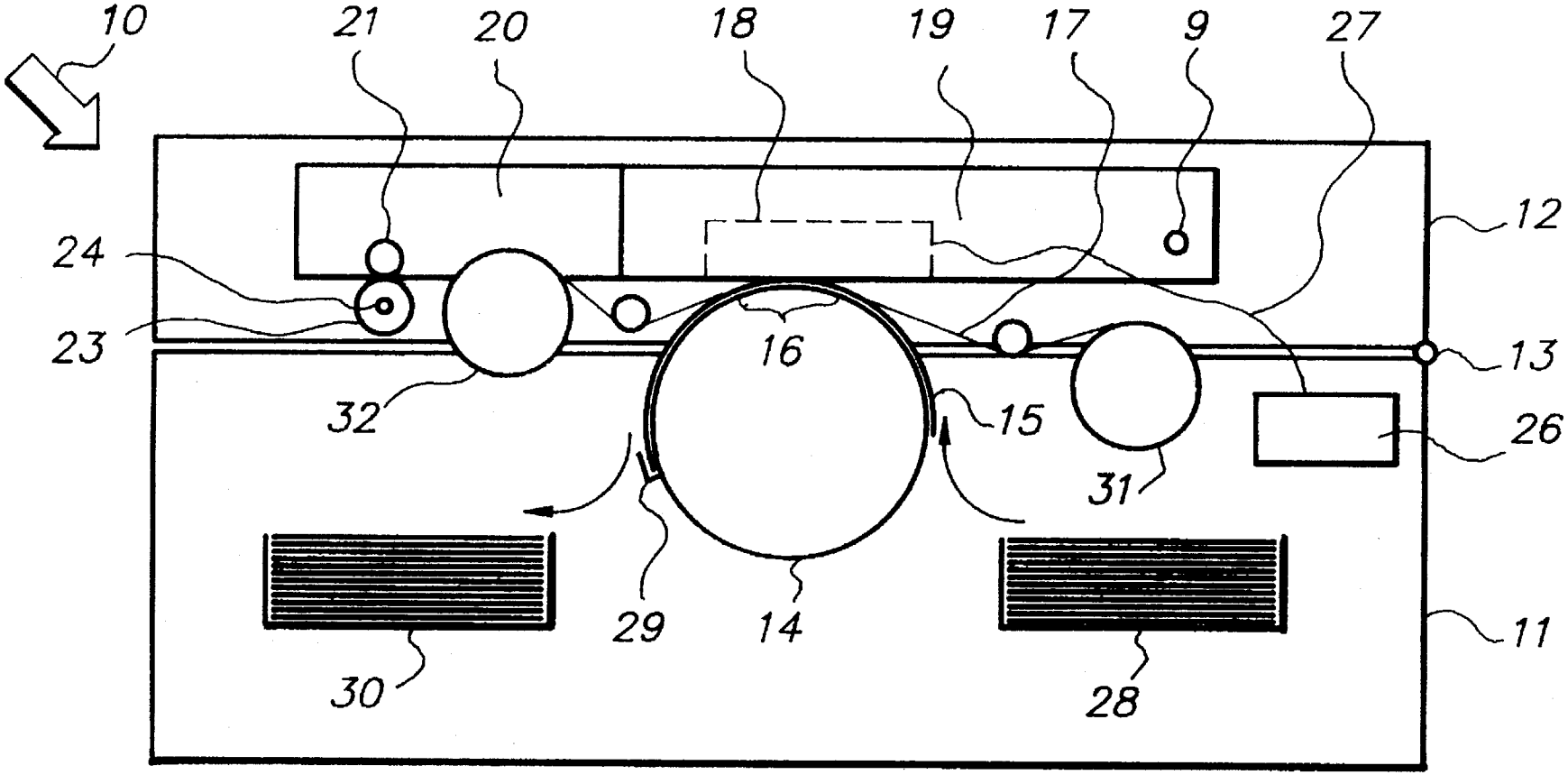
FIG. 1 is a diagrammatic representation of one embodiment of a thermal image-recording apparatus according to the present invention, the print head being in the operative position.

FIG. 1 shows a diagrammatic representation of one embodiment of a thermal image recording apparatus according to the present invention.

The apparatus is mounted in a housing 10 having a base 11 and a lid 12 hinged to the base at 13, and generally comprises a cylindrical print drum 14 which functions to support and transport a recording medium such as a print receiver sheet 15 through a print zone 16 where it receives thermally printed information.

Thermal printing is effected by advancing a dye-bearing donor ribbon 17 through the print zone between the print-receiver sheet 15 and a print head 18.

Figure 2:
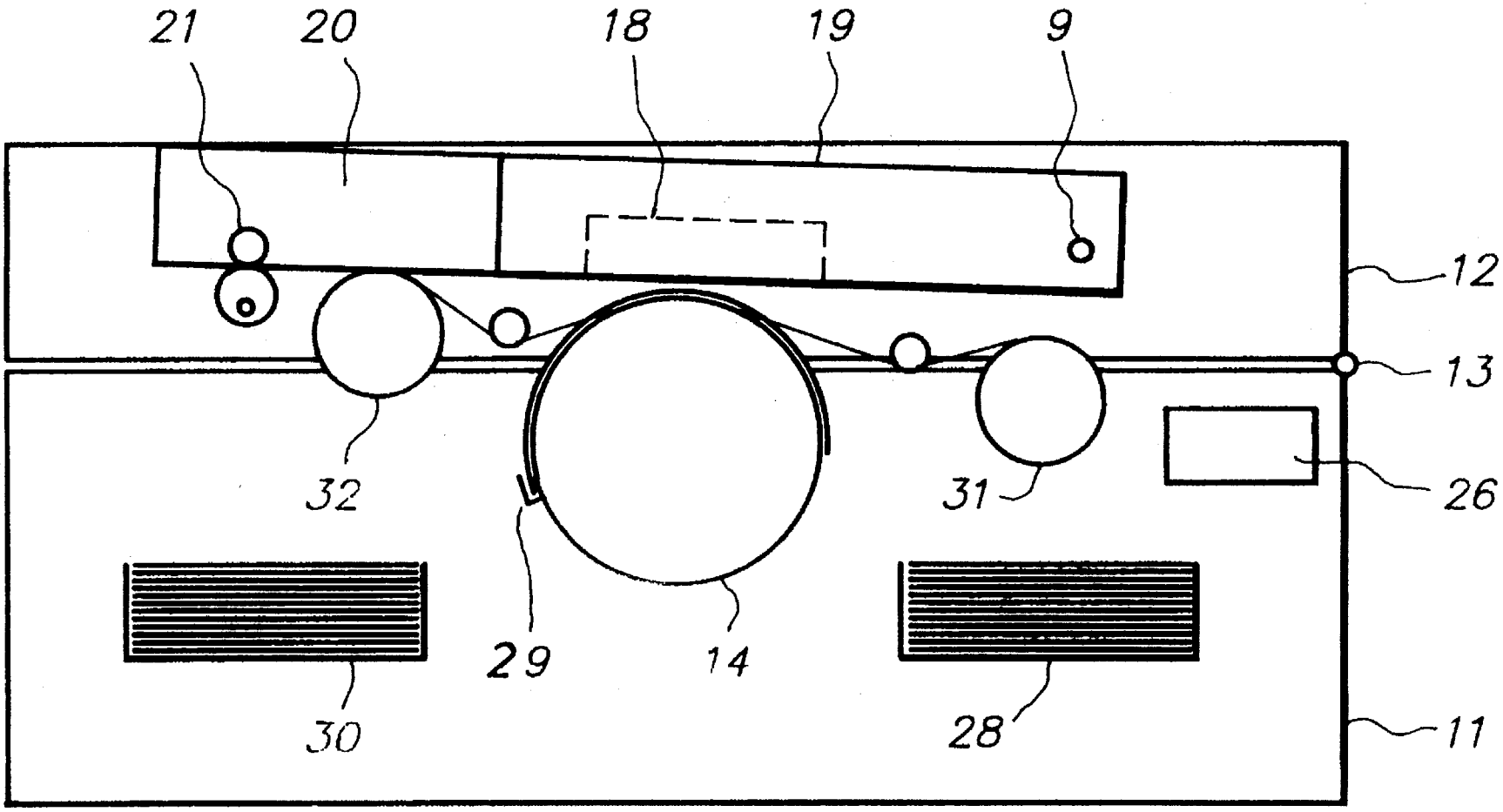
FIG. 2 shows the apparatus according to FIG. 1 with the print head in the inoperative position.

The print head is shown in broken lines and is mounted in a subhousing 19 mounted in lid 12 pivotable about a pin 9. The subhousing has two arms 20 spaced in parallel, which are interconnected by a rod 21. Rod 21 rests on a cam 23 mounted on shaft 24 equally mounted with its driving motor (not shown) in lid 12. Rotation of the cam shifts the print head from its print position in which it presses against the print drum and the media therebetween (see FIG. 1), to a non-printing position in which the print head is spaced from the print drum (see FIG. 2).

Print head 18 spans the print drum and is of conventional design, comprising a linear array 25 (see FIG. 6) of closely spaced resistive elements, each being independently addressable with image information by an applied voltage provided by a microprocessor 26 connected via leads 27. As each resistive element is addressed, it heats that portion of the donor ribbon directly opposite, thereby causing dye to transfer from the donor ribbon to the print-receiver sheet. In colour thermal printers, the donor ribbon usually comprises patches of cyan, yellow and magenta dyes in a repeating series, and the print-receiving sheet is rotated three times through the print zone to receive a full-colour image. The print receiver sheets are fed to the drum from a sheet supply 28 and are clamped to the drum by a suitable clamping mechanism 29. Upon receiving the thermal image, the clamping mechanism releases the print-receiver sheet allowing it to enter an output tray 30, which has been illustrated within the housing but which may be located in front of the apparatus as well. Print drum 14 is rotatably driven by a precision stepper motor, which in turn is controlled by microprocessor 26. The microprocessor also functions to control the position of the subhousing via cam 23 so as to move print head 18 to its non-printing position to allow passage of the clamping mechanism through the print zone.

The dye-bearing donor ribbon 17 is fed from a supply spool 31 to a take-up spool 32 driven by a suitable motor. Both spools can be fitted in a disposable cassette for ease of handling, as known in the art.

Figure 3:
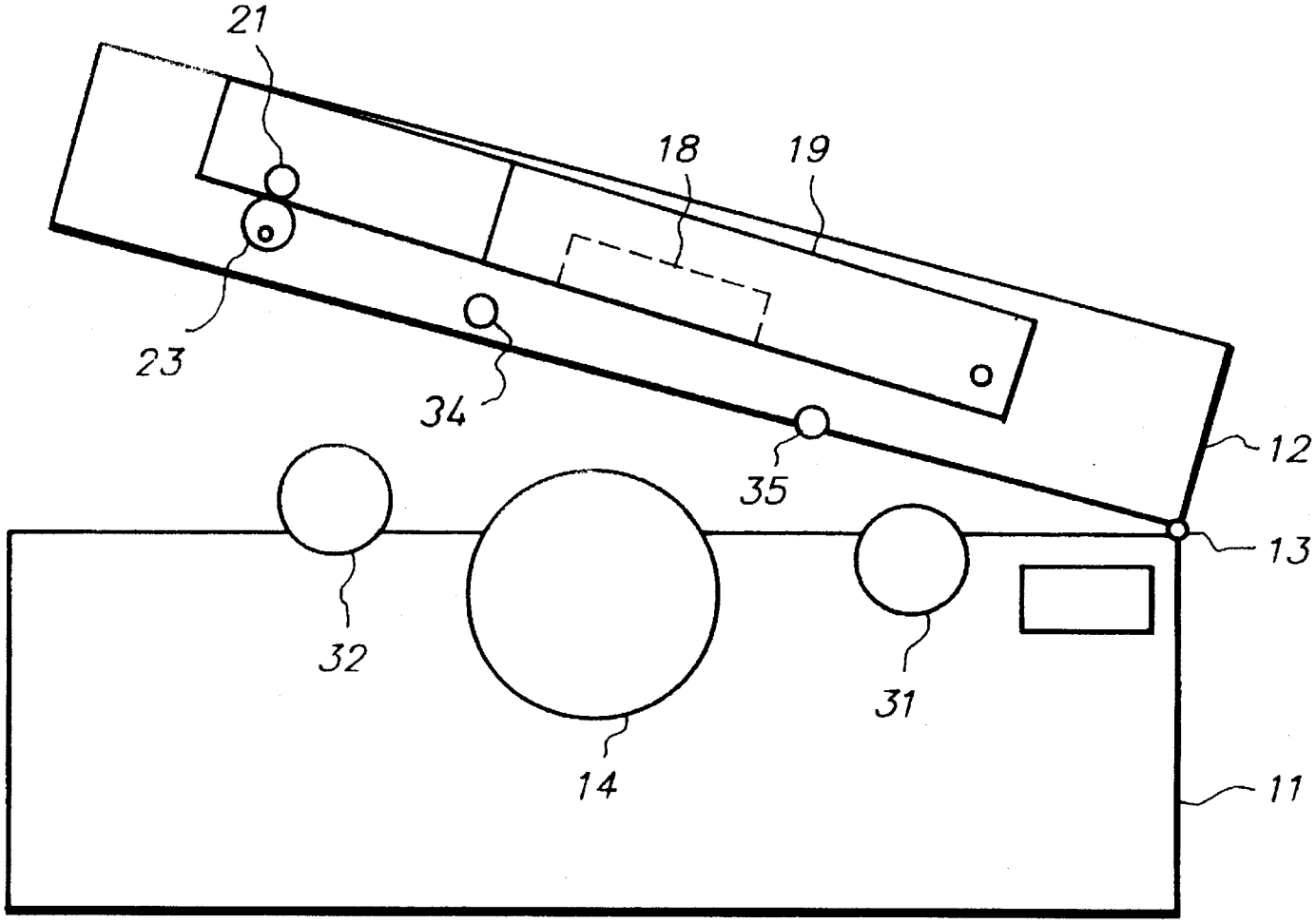
FIG. 3 shows the apparatus according to FIG. 1 with the lid opened.

FIG. 3 shows the apparatus with lid 12 opened. In this position the print head is brought into its non-printing position by appropriate rotation of cam 23. This figure also shows that rollers 34 and 35 controlling the path of the dye-donor ribbon move together with lid 12.

Figure 4:
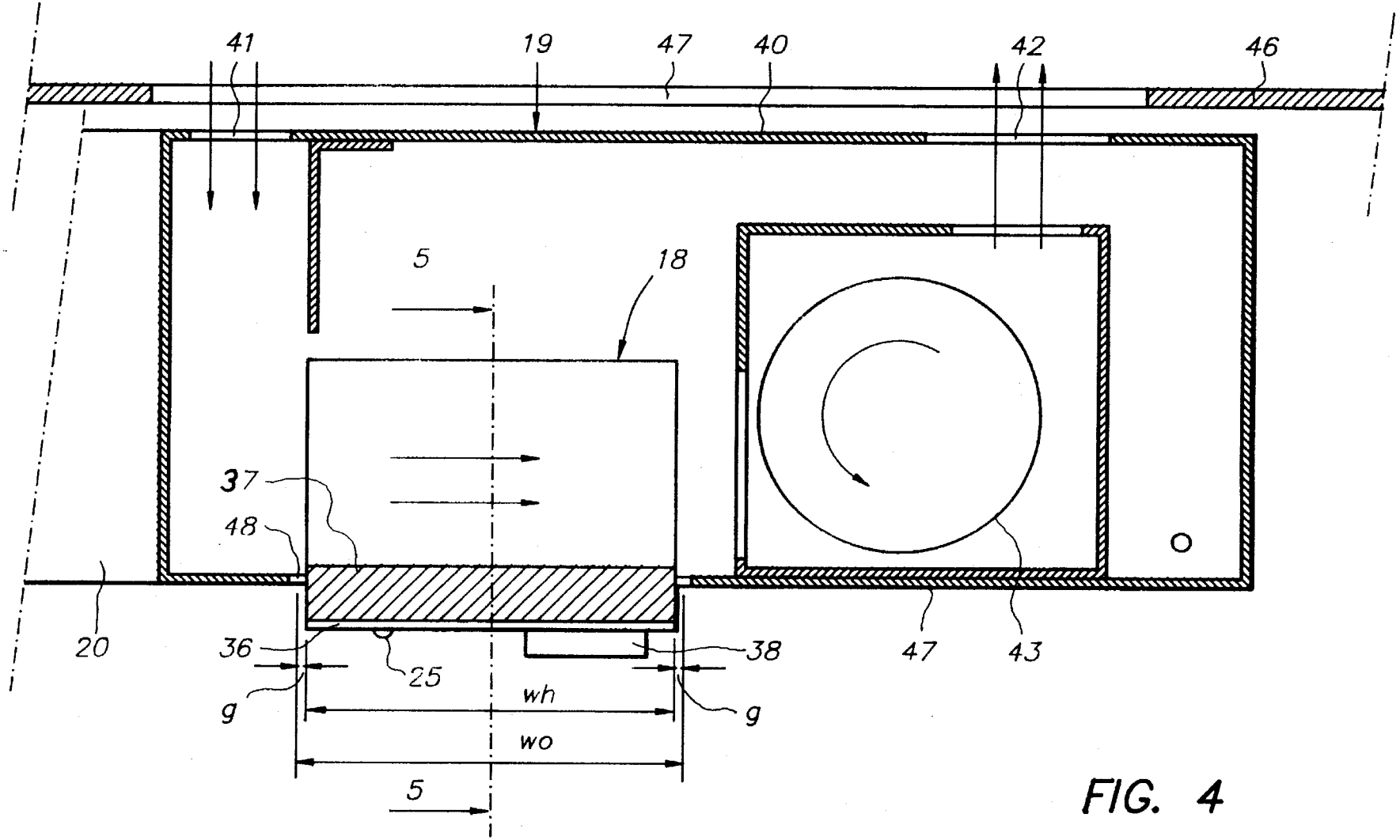
FIG. 4 is an enlarged cross-sectional view of the subhousing of the apparatus according to FIG. 1.
Figure 5:
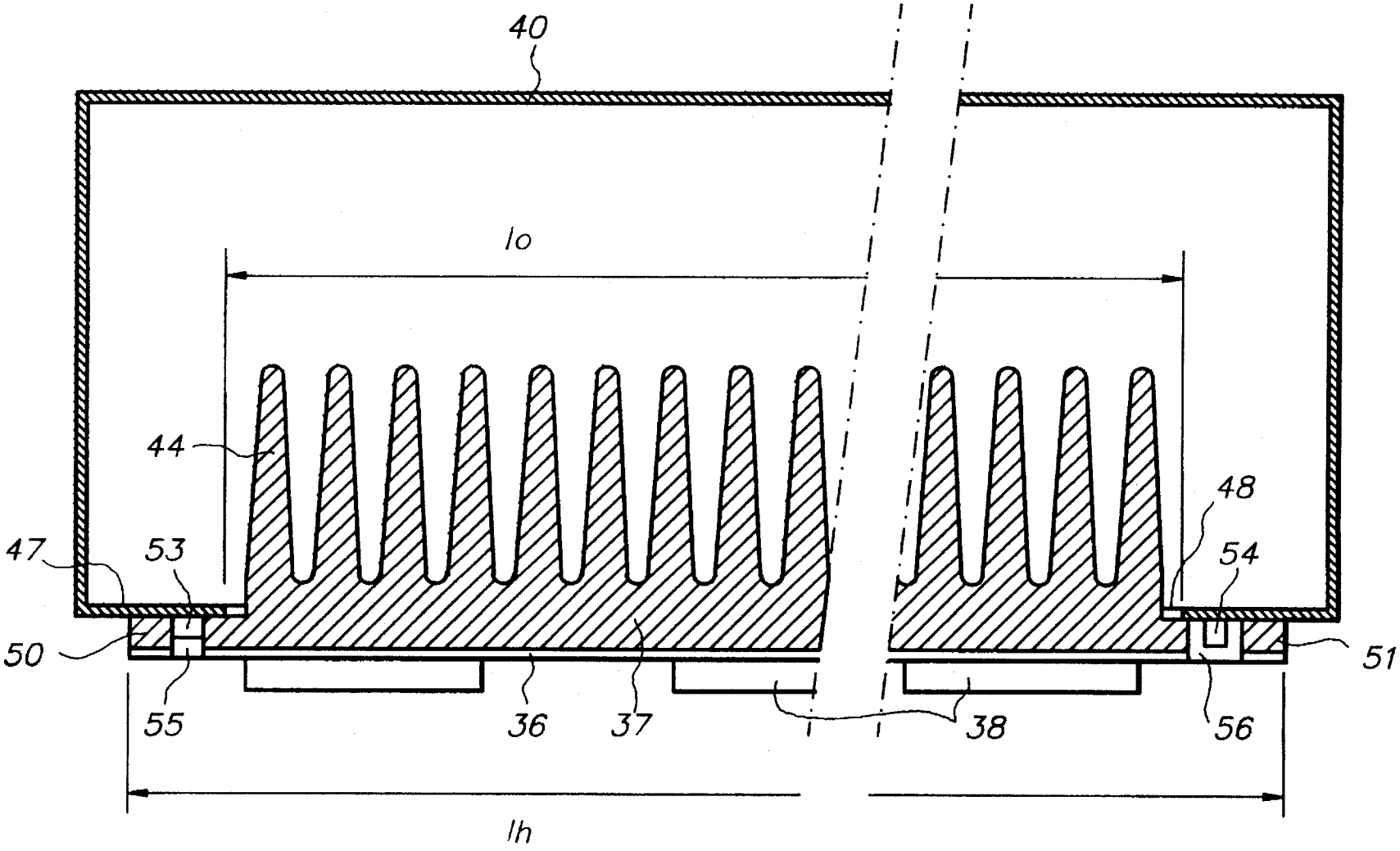
FIG. 5 is a cross-section on line 5—5 of FIG. 4.
Figure 6:
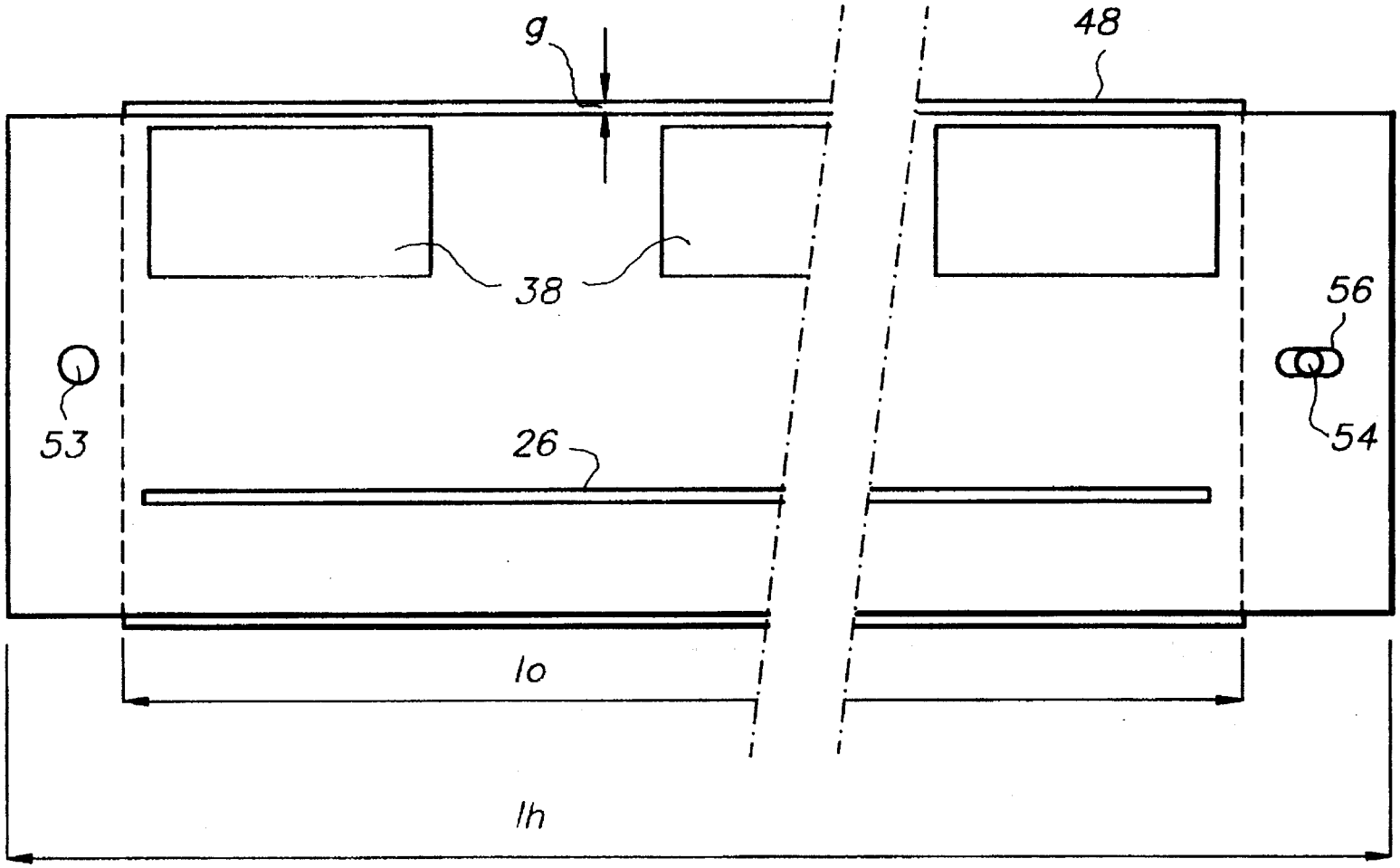
FIG. 6 is a bottom plan view of the print head

The mounting and the cooling of the print head in accordance with the present invention are illustrated in detail in the enlarged views of FIGS. 4 to 6.

Referring to FIG. 4, the print head 18, which is mounted in subhousing 19, is in fact an assembly of a thermal print circuit board 36 and a heat sink 37 as described in the introduction of this specification. Board 36 has a linear array 25 of heating elements and a number of electronic components 38 comprising shift registers, buffers, etc., and integrated connectors for electrically connecting the head to flexible leads. The described connectors facilitate the easy replacement of the print head. Such replacement tends to occur rather frequently in practice since the lifetime of thermal print heads of the described type is limited.

Subhousing 19 has in its top wall 40 an elongated rectangular air intake opening 41 and a similar air-exhaust opening 42.

Air drawn into the subhousing by a common tangential type blower 43 flows through the housing as indicated by the parallel arrows and convects heat from fins 44 of fin 37. Upper wall 46 of lid 12 of the apparatus has been partly shown in FIG. 4. This wall may have a large opening 47 covered by a perforated plate or the like, thereby assuring for the openings 41 and 42 free access to the environmental air, but said wall may also have two wider slotlike openings corresponding with the openings of the subhousing. The openings of the subhousing can be provided with ducts engaging corresponding openings in wall 46 so as to limit air communication between the subhousing and lid 12 of housing 11 to a strict minimum. However, an absolute prevention of any communication is not necessary since a minor amount of cooling air circulating through the apparatus will not impede the proper functioning thereof.

The mounting of the print head in the subhousing is described with reference to FIGS. 4 to 6.

Bottom wall 47 of subhousing 19 has a rectangular opening 48, the periphery of which is illustrated in FIG. 6. The width wo of this opening is slightly wider than the width wh of the print head, whereas the length lo of the opening is notably shorter than the length lh of the head.

With reference to FIGS. 5 and 6, heat sink 37 of the print head has two shoulders 50 and 51 obtained by cutting away a portion of the fins 44 near the lateral ends of the heat sink. The top surface of these shoulders is reasonably straight so that they fit tightly against the corresponding section of the bottom wall 47 of the subhousing. The portion of the heat sink comprised between said two shoulders extends through opening 48 inside the subhousing and a minor gap g is left between the longitudinal faces of the base of the sink and the corresponding edge of the opening. Practice has shown that this gap need not be larger than approximately 0.5 mm to allow for common dimensional fabrication tolerances of the head and the opening 48. A value up to 0.25 mm does not cause particular problems.

Air leakage through this gap is neglectable as compared with the rate of air able to pass through the cross sectional area of openings 41 and 42.

It would have been possible to enclose the print head in all sides by providing a shoulder covering the full periphery of the base of the heat sink but this would put great demands on the flatness of the bottom wall (usually sheet metal) of the subhousing in order to be sure the print head would be uniformly supported at all points along the periphery. The described technique of supporting the lateral ends only of the print head offers a reliable and above all reproducible mounting of the head and of a replacement head.

The shoulders of the print head may have been obtained by cutting away portions of a standard-type heat sink and next machining the supporting surfaces, but the heat sink may also have been integrally extruded to the required shape.

Exact positioning of the print head on the bottom wall of the subhousing is obtained via two register pins 53 and 54 extending from the bottom wall and engaging a corresponding bore 55 in the shoulder of the head on one end, and a slotlike hole 56 at the opposite end.

Attachment of the print head can occur in a simple way by means of some screws passing through bores in the shoulders of the heat sink, spaced from the registering bores, and engaging corresponding threaded holes in the bottom wall of the subhousing.

However, an interesting clamping mechanism for holding the print head which does not require the use of any tool is disclosed in our co-pending application Ser. No. 08/161,314 filed on even day herewith and entitled: "Thermal image recording apparatus with detent means for holding a print head".

The mounting and demounting of the described print head is extremely sample. The operator, whether a service engineer or an unskilled operator, removes the electric plugs of the flat cables from the connectors 38, Then unlocks or unscrews the head and next simply takes the head out of the opening of the subhousing which, the lid being opened (the opening will be wider than shown in FIG. 3), is easily accessible. Replacement of the head occurs in reversed order.

In operation of the image-recording apparatus, it was shown that the cooling of the print head was excellent and that the very small leakages of air near the print head and at the cross-over from the subhousing to the housing cause neither a temperature rise nor a hindering air current in the main housing. The array of resistive heating elements remained remarkably clean over longer periods of use of the apparatus.

The invention is not limited to the embodiment described hereinbefore.

The intake opening for the cooling air may be provided with filter means to reduce deposition of dust and the like on the fins of the heat sink possibly causing a reduction of heat transfer in the long run.

Ducts of openings 41 and 42 of the subhousing can coaxially engage corresponding ducts in openings of top wall 40 so that occasional air leakage in the apparatus is still further reduced. Finally resilient sealing rings or the like can be used for airtightly interconnecting openings 41 and 42 with the outside atmosphere, as subhousing 19 is moved upwardly and downwardly under the control of cam 23, and/or for providing an airtight fit of the print head in the opening.

The intake and/or outlet openings for cooling air can also be located in one or more lateral walls of the sub-housing rather than in the top wall.

The supply and take-up rolls for the dye-donor ribbon need not be provided in a disposable cassette, but can also be supported in a dedicated frame, which is loaded by the operator with dye-donor ribbon outside of the apparatus. Suchlike arrangement is disclosed in U.S. application Ser. No. 08/136,267, now U.S. Pat. No. 5,415,486 entitled "A dye ribbon package for use with a thermal printer and a method of loading the reloadable cassette of a thermal printer with a dye ribbon from a dye ribbon package".

We claim:

1. In a thermal image-recording apparatus for recording an image on a recording medium, said apparatus having a housing enclosing a platen roller adapted to support said medium in recording position, a print head comprising a thermal print circuit on a face thereof adjacent to said platen roller, said print circuit including an array of individually activatable heating elements for forming said image on said medium, and a heat sink projecting away from said face and in heat conductive relation to said heating elements for conducting heat therefrom, ventilating means for producing a stream of air flowing in contact with said heat sink for cooling said heat sink, and air guiding means for guiding said stream of air after its contact with said heat sink to the atmosphere outside said housing, in combination, the improvement wherein said print head is mounted in a subhousing which is movably mounted in said housing for bringing said print head into and out of an operative position with said heating elements proximate to said medium in recording position on said platen roller, said subhousing has an opening in a first wall thereof facing said platen roller, said print heat is disposed within said subhousing with said heating elements projecting through said opening for exposure of said elements to said medium when said subhousing is in said operative position and said heat sink extending into the interior of said subhousing, said subhousing is closed on all sides thereof except for said opening and for air intake and air exhaust openings that communicate directly with the atmosphere outside said housing without substantial communication with the housing interior, and the ventilating means is mounted in said subhousing for drawing air through the air intake opening, directing a stream of said air in contact with the heat sink and discharging the stream of air thus heated to the outside atmosphere through the air exhaust opening.

2. A thermal image-recording apparatus according to claim 1, wherein the housing has a base and a cover and said subhousing is mounted on an interior side of said cover.

3. A thermal image-recording apparatus according to claim 1, wherein said heat sink has a width wh which is smaller than a width wo of said opening through which said heating elements project, and said heat sink has a length lh which is larger than a length lo of said opening, thereby providing at each lateral end of the mounted head a shoulder extending in overlapping relation to margins of the bottom wall of the subhousing adjacent ends of said opening for attachment thereto.

4. A thermal image-recording apparatus according to claim 3, wherein any gap between an edge of said print head and an adjacent edge of the opening in the wall of the subhousing is less than 0.5 mm.

5. A thermal image-recording apparatus according to claim 3, wherein one of said shoulder, has a circular opening therein and the other one an elongated opening therein, both openings cooperating with corresponding register pins on said wall of the subhousing for precisely locating said print head within said subhousing.

6. A thermal image-recording apparatus according to claim 1, wherein said air intake and exhaust openings are located in a second wall of said subhousing opposite to said first wall and communicate with the air outside said housing through a corresponding opening in a wall of said housing.

7. A thermal image-recording apparatus according to claim 1, wherein said air intake and exhaust openings are rectangular openings having their lengthwise axis extending parallel to each other.

8. A thermal image-recording apparatus according to claim 7, wherein said ventilating means is a tangential-type blower having an axis extending parallel with the lengthwise direction of said intake and exhaust openings.

* * * * *